US007434550B2

(12) United States Patent
Hofbauer

(10) Patent No.: US 7,434,550 B2
(45) Date of Patent: Oct. 14, 2008

(54) INTERNAL COMBUSTION ENGINE

(75) Inventor: Peter Hofbauer, West Bloomfield, MI (US)

(73) Assignee: Advanced Propulsion Technologies, Inc., Goleta, CA (US)

( * ) Notice: Subject to any disclaimer, the term of this patent is extended or adjusted under 35 U.S.C. 154(b) by 17 days.

(21) Appl. No.: 11/811,242

(22) Filed: Jun. 8, 2007

(65) Prior Publication Data

US 2007/0283909 A1 Dec. 13, 2007

Related U.S. Application Data

(60) Provisional application No. 60/813,021, filed on Jun. 13, 2006.

(51) Int. Cl.
*F01B 7/12* (2006.01)
*F02B 75/22* (2006.01)

(52) U.S. Cl. ..... 123/51 R; 123/51 B; 123/55.2; 123/55.7

(58) Field of Classification Search ..... 123/51 R, 123/51 A, 51 B, 51 BB, 51 BD, 54.1, 55.2, 123/55.4–55.7
See application file for complete search history.

(56) References Cited

U.S. PATENT DOCUMENTS 6,170,443 B1 1/2001 Hofbauer

*Primary Examiner*—Noah Kamen
(74) *Attorney, Agent, or Firm*—Paul K. Godwin

(57) ABSTRACT

An improved configuration for an opposing piston-opposing cylinder ("OPOC") internal combustion engine with a single camshaft to reduce friction between the pistons and the cylinder walls during the combustion phase of the engine cycle. The improvements are presented in two embodiments that provide offsets between the bore axes of the cylinders and the crankshaft axis of rotation to cause the connecting rods to achieve an orientation substantially parallel to the cylinder bore at TDC and shortly thereafter.

20 Claims, 7 Drawing Sheets

INTERNAL COMBUSTION ENGINE

RELATED APPLICATION

This application claims benefit of U.S. provisional application Ser. No. 60/813,021 filed Jun. 13, 2006.

TECHNICAL FIELD

This invention is related to the field of internal combustion engines and more specifically to improvements in such engines configured with a single crankshaft and having opposing cylinders and opposing pistons in each cylinder ("OPOC engine").

BACKGROUND

This invention involves improvements to internal combustion engines and in particular the OPOC engine described and claimed in my earlier U.S. Pat. No. 6,170,443, which is incorporated herein by reference.

SUMMARY

The present invention provides several improvements to the friction and vibration characteristics of the earlier described OPOC engine. By enhancing the orientation and disposition of the various elements of the engine I have realized a further improvement in decreasing the friction and vibration caused by side forces applied between the pistons and the cylinder walls at critical times during each engine cycle and by balancing the gas-forces and the mass-forces.

In a first embodiment, the opposing cylinders are disposed at substantially the same level when oriented along the horizontal. The centers of the pistons in the cylinders move linearly within the cylinders along cylinder axes which define a common plane. The crankshaft, to which the pistons are connected, has an axis of rotation that runs perpendicular to the direction of movement of the pistons and parallel to the common plane but offset or separated from the common plane by a predetermined distance. The distance is selected so that the asymmetric arranged crank journals, which are oriented to achieve asymmetric port timing and balanced mass-forces, cause the center lines of the piston rods to be aligned along the common plane when their respective pistons are at TDC (top-dead-center) of their cycle and immediately after. With such alignment, no side forces are applied to the pistons when combustion occurs and side wall friction is minimized. With such friction minimized, there is a reduction in vibration and an increase in operating efficiencies.

In a second embodiment, the pistons in one of the two opposing cylinders have centers which move along a first axis that corresponds to the axis of its cylinder bore. The first axis is perpendicular and intersects the axis of rotation of the crank shaft to define a first plane. The pistons in the other opposing cylinder are disposed to have their centers move along a second axis that corresponds to the axis of its cylinder bore and is parallel to the first axis but offset from said first plane by a predetermined distance. In this embodiment, the center lines of each of the piston rods extending from the inner pistons of each cylinder to the corresponding asymmetric arranged crank journals are substantially parallel to the axis of their corresponding inner pistons when each corresponding inner piston moves past its TDC position. This corresponds to the point where the expansion forces reach their peak during the combustion portion of the cycle. By positioning the inner piston connecting rods to be substantially parallel with piston movement at this selected spot in the cycle, no side forces are applied to the side walls during combustion and friction is minimized to provide greater efficiency during each power stroke.

It is an object of the present invention to provide an improved OPOC engine with reduced friction and vibration characteristics and increased efficiencies by eliminating side forces on the pistons at critical points in the engine cycle.

It is another object of the present invention to provide a method of reducing friction between pistons and cylinders in an internal combustion engine containing at least one pair of opposed cylinders, a pair of opposing inner and outer pistons in each cylinder, a single crankshaft, and a plurality of piston rods each connected between a piston and a corresponding asymmetric journal on said crankshaft, utilizing the steps of: positioning the cylinders opposing each other to have the centers of the opposing pistons within each cylinder move along the longitudinal axis of the cylinder during engine operation; defining a centerline in each piston rod that extends between each piston connection and each journal connection; positioning the crankshaft and asymmetric journals between the opposing cylinders to have the centerline of each piston rod connected between the inner piston and its corresponding journal oriented to be substantially parallel with the axis of longitudinal movement when the combustion forces reach their peak just after the inner piston reaches its TDC position of the engine cycle.

It is a further object of the invention to provide an improved internal combustion engine by: positioning the cylinders opposing each other to have the longitudinal axis of each cylinder lie in a common plane; and positioning the crankshaft and the asymmetric journals between the opposing cylinders to have the crankshaft axis of rotation offset a predetermined distance from the common plane and to cause the centerlines of the piston rods for both inner and outer opposing pistons to be substantially parallel to the corresponding cylinder axis when the combustion forces reach their peak just after said opposing pistons reach their TDC position of the engine cycle.

DETAILED DESCRIPTION OF THE INVENTION

Figure 1:
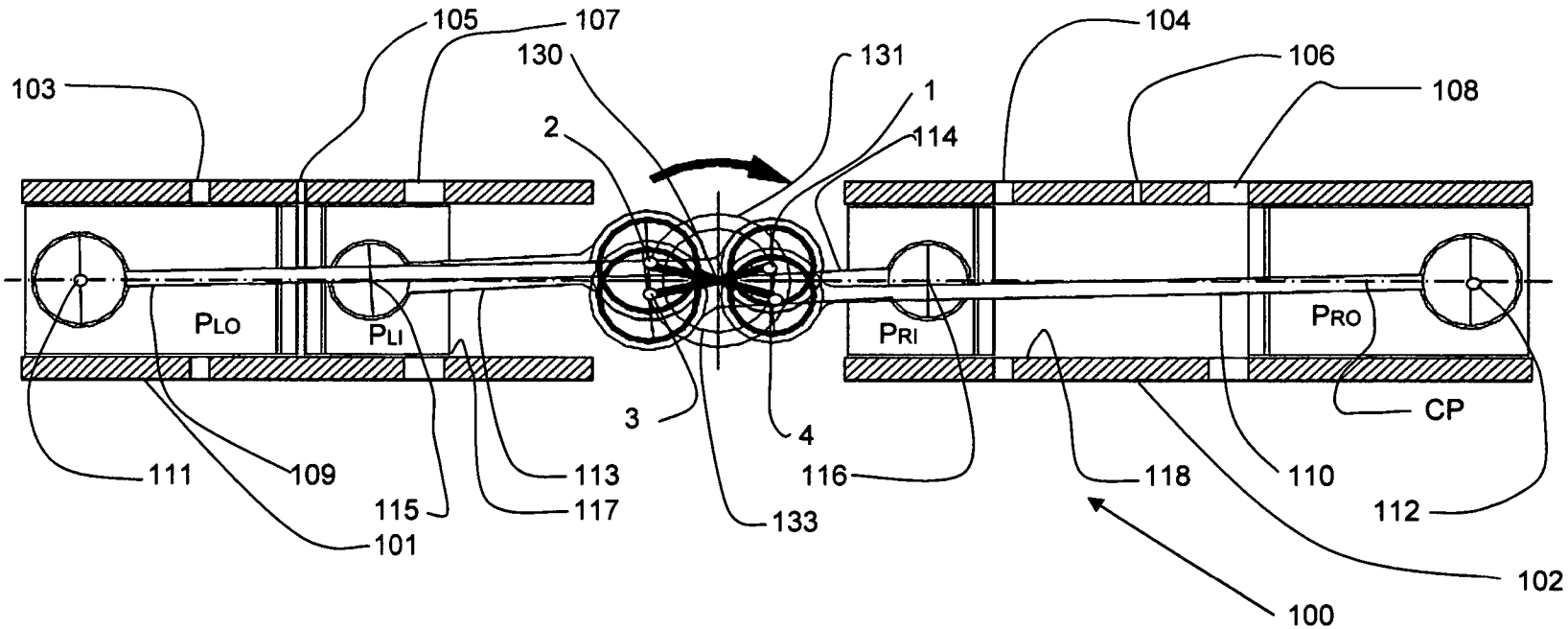
FIG. 1 is a cross-sectional plan view showing the operative elements of a prior art OPOC engine configuration in which the crankshaft axis of rotation and axis of piston movements lie in substantially the same plane.

In FIG. 1 a conventional configuration of an OPOC engine 100 is illustrated. The engine comprises a pair of opposing cylinders which are designated there as left cylinder 101 and right cylinder 102. The left cylinder 101 houses an opposing pair of pistons PLO and PLI, respectively meaning the "left outer piston" and the "left inner piston", that move linearly within the cylinder wall 117. The right cylinder 102 houses an opposing pair of pistons PRO and PRI, respectively meaning the "right outer piston" and the "right inner piston", that move linearly within the cylinder wall 118. The cylinders 101 and 102 have represented intake ports 103 and 104, exhaust ports 107 and 108, and fuel injection ports 105 and 106.

Although the engine is shown to lying in a generally horizontal plane, it can be operated in other orientations as well. For reference convenience in this description and the drawings, directions may sometimes be referred to as horizontal or vertical in order to indicate their orthogonal relationships.

A crankshaft is represented with its axis of rotation 130 centered between the opposing cylinders and oriented perpendicular to the drawing surface and the orientation of the cylinders. Piston rods 109 and 113 connect between the centers of pistons PLO and PLI and asymmetric journals 1 and 2 on the crankshaft. Similarly, Piston rods 110 and 114 connect between the centers of pistons PRO and PRI and asymmetric journals 4 and 3 on the crankshaft.

FIG. 1 shows the engine at a crankshaft position of 0 degree. (Defined as "Top Dead Center," or TDC, of the left cylinder). At this position, the left outer piston PLO and left inner piston PLI are very near their point of closest approach to each other. At approximately this angle of crankshaft rotation, in a direct injection version of the engine, a fuel charge would be injected into the left cylinder at injection port 105 and combustion would begin. At this point the intake port 103 and exhaust port 107 of the left cylinder 101 are completely closed by PLO and PLI respectively. Since the timing of the pistons actuating the exhaust ports are advanced by approximately 12.5 degrees and the timing of the pistons actuating the intake ports are retarded by approximately 17.5 degrees, both pistons PLO and PLI are subjected to a slight motion to the right after reaching TDC, (the inner left piston, PLI, having just reversed direction). The paths of movements of the asymmetric journals 2 and 3 on the crankshaft are represented by the outer circle 131, while the movements of the asymmetric journals 1 and 4 on the crankshaft are represented by the inner circle 133. The crankshaft throws and the advancing and retarding angulars of the two pistons are different, but the piston velocities at TDC are the same.

In the right cylinder 102, the right inner piston PRI and right outer piston PRO are shown to be near their maximum separation at bottom dead center ("BDC"). Both the intake port 104 and exhaust port 108 of the right cylinder 102 are open, and the exhaust gases from the previous combustion cycle are being scavenged. Like the pistons in the left cylinder, both PRI and PRO have a slight velocity, in this case both towards the left, with the outer piston PRO having just changed direction after reaching BDC.

Figure 2:
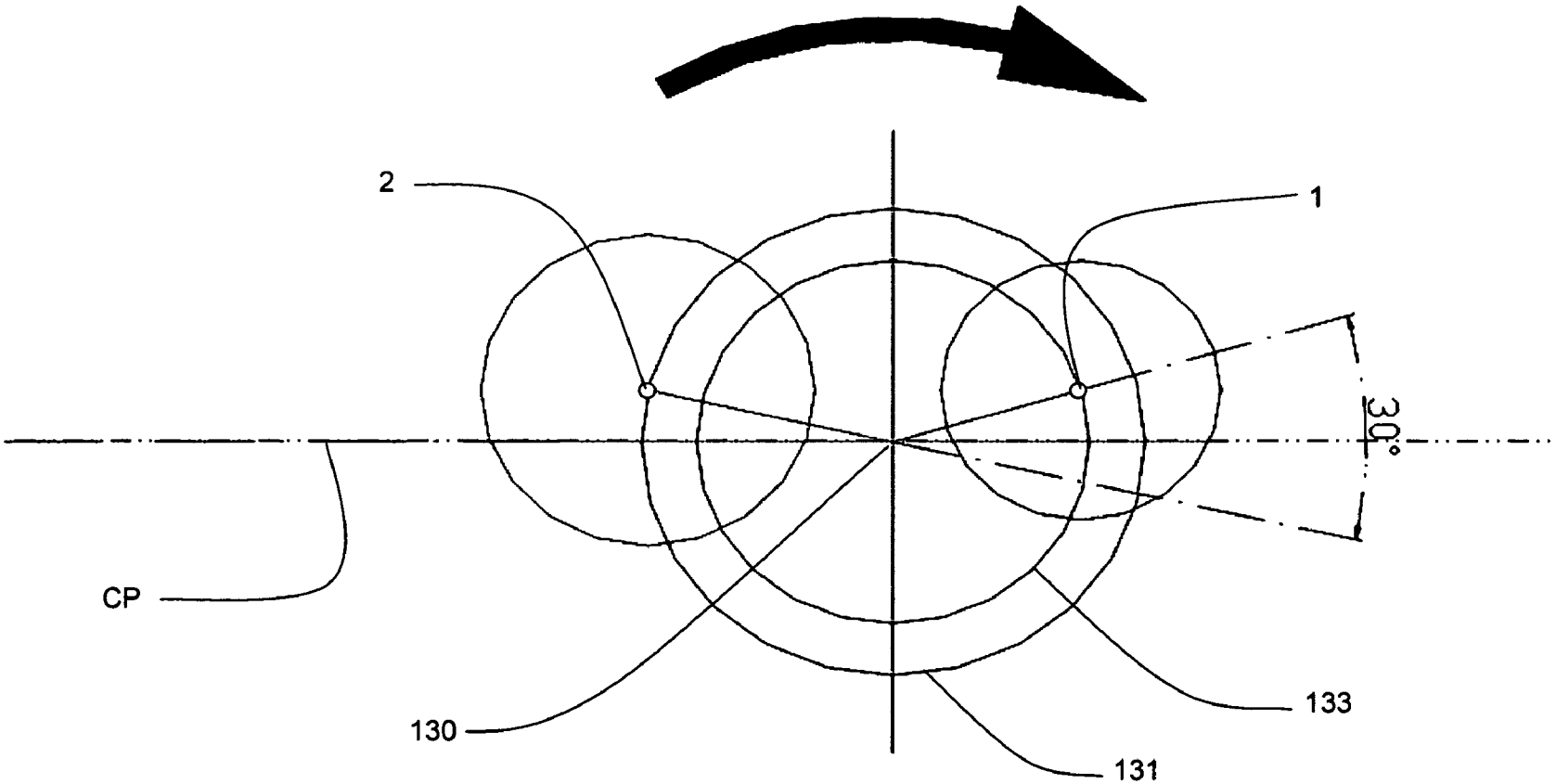
FIG. 2 is a diagram showing the rotation axis of the crankshaft in the center of two concentric circles which respectively represent the paths traveled by the piston journals of FIG. 1, during the engine cycle; and the location of the left piston journals at TDC.

In FIG. 2, the dash-dofted line CP represents the common plane in which the center lines or axes of the cylinder bores and crankshaft axis of the prior art OPOC engine shown in FIG. 1 are located. The two circles 131 and 133 represent the circular paths on which the center of the journal crankpin 1 for inner piston push rod 113 and crankpin 2 for outer piston pull rod 109 are rotating. Because the masses of the outer pistons plus connecting pull rods are usually heavier than the masses of the inner pistons and the connecting push rods, the strokes of the outer pistons have to be smaller than the strokes of the inner pistons to balance the engine. A phase angle of 30 degrees (as an example) is shown between the two crankpins. The crankpins 1 and 2 are represented as being located at TDC for the left cylinder.

Figure 3:
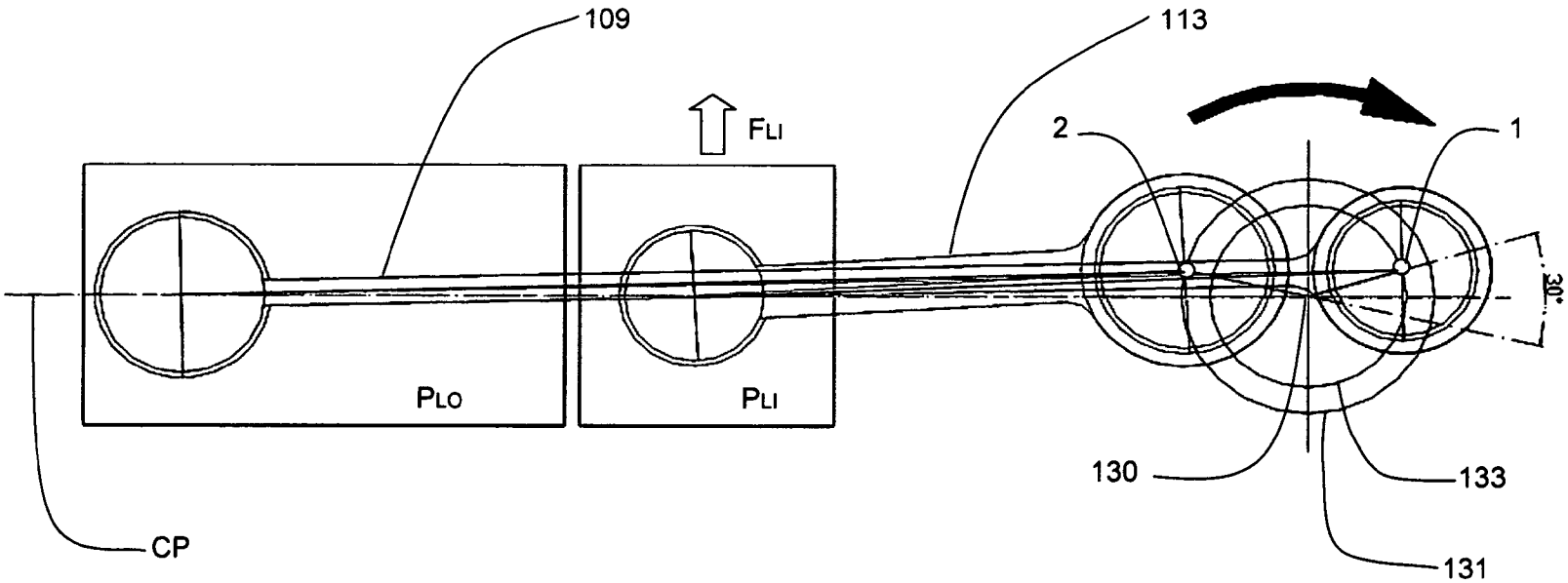
FIG. 3 is a simplified diagram showing the left pistons, connecting rods and crankshaft of FIG. 1 at TDC.

FIGS. 1-3 illustrate the fact that in a conventional OPOC where the piston centers and cylinder bore axes all lie substantially in a common plane CP along with the rotational axis 130 of the crankshaft, none of the connecting rods are parallel to the plane when the engine is at TDC or even shortly after TDC (note crankshaft movement is illustrated as clockwise). In FIG. 3, it is more clearly shown that there is an angle between the center lines defined in the push and pull rods 113 and 109 and the center lines or axes of the bores lying in the plane CP when the left cylinder is at TDC. This is due to the slight elevation of the crankpins 1 and 2 above the axis 130 at TDC. (An identical situation occurs for the right cylinder when it is at TDC.) Due to this angle, the combustion expansion movement of the pistons acting on their respective connecting rods cause side forces FLO and FLI to be developed and exerted between the pistons and the side wall 117 during the period when the combustion pressure is a maximum. Such side forces produce friction and therefore have an adverse impact on engine efficiency.

Figure 4:
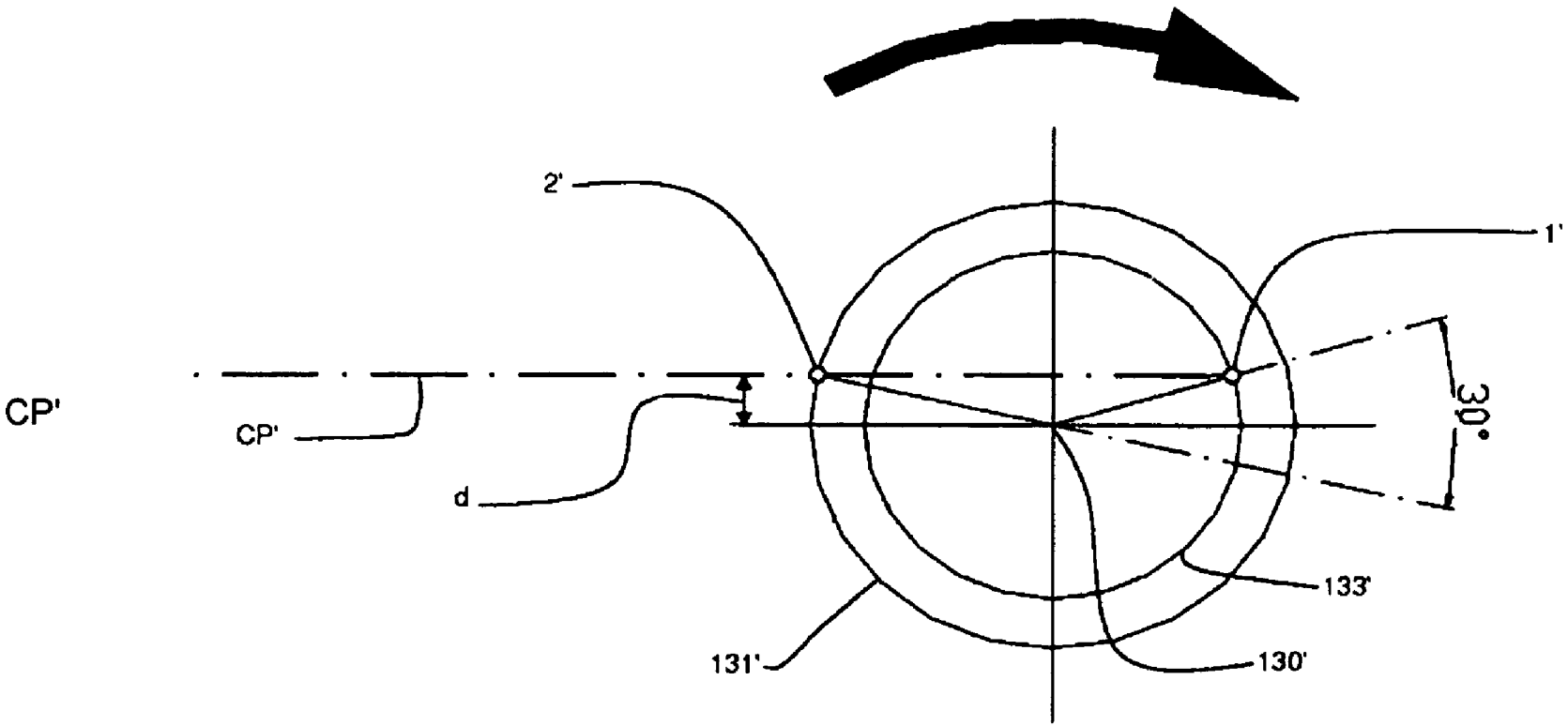
FIG. 4 is a diagram showing the rotation axis of the crankshaft in the center of two concentric circles which respectively represent the paths traveled by the piston journals in the first embodiment of the present invention during the engine cycle; and the location of the left piston journals at TDC.
Figure 5:
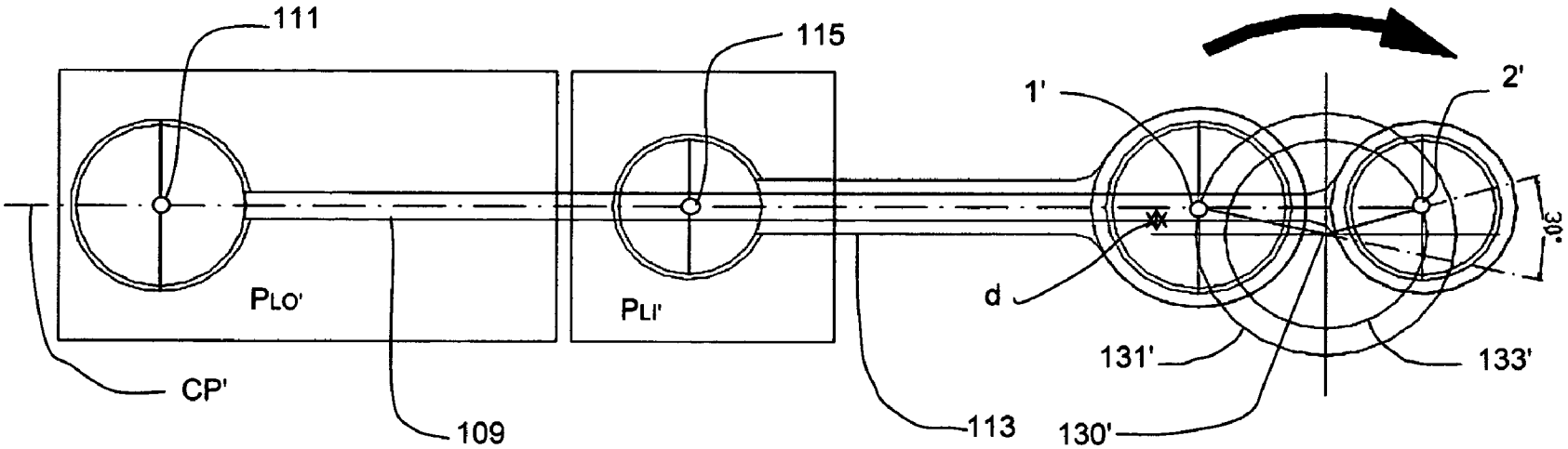
FIG. 5 is a simplified drawing of the left pistons, connecting rods and crankshaft of the first embodiment of the present invention at TDC.

The first embodiment of the present invention is described with reference to FIGS. 4 and 5. In this first embodiment, the opposing cylinders 101 and 102 of the engine, as shown in FIG. 1, remain oriented so that the axes of the cylinder bores and the linear paths that the centers of the pistons move along are substantially parallel and lie in a common horizontal plane CLC. However, in this first embodiment, the axis of rotation 130' of the crankshaft is vertically offset by a predetermined distance "d" as shown in the left cylinder diagram of FIG. 4. The journal crankpins 1' and 2' are respectively repositioned on the crankshaft to rotate on circles 133' and 131' and maintain the same phase angle as in the conventional engine for which asymmetric timing is achieved. In this example the phase angle is 30 degrees. The diagrams in FIGS. 4 and 5 show the position of the crankpin journals 1' and 2' when the left cylinder is at TDC. Although not shown, the same orientations are present in the right cylinder in this embodiment when its opposing pistons PRO and PRI reach TDC with equal results.

In FIG. 5, the locations of the pistons PLO and PLI and connecting rods 109 and 113 of the left cylinder at TDC are shown in conformance with the diagram of FIG. 4. In this configuration, the crankshaft axis of rotation is offset a distance "d" from the common plane CP' defined by axes of the opposing cylinders; or from the cylinder axis if the cylinders are aligned along a common axis. The result of using an offset crankshaft axis is that an engine can be designed where the center lines defined in the connecting rods for all the pistons are substantially parallel to the common plane (movement of piston centers) when the engine reaches TDC in its cycle and slightly thereafter. In this configuration, side forces which would be otherwise normally applied to the pistons at the peak of the combustion phase (power stroke) are minimized. Since the forces that occur from combustion just after TDC are applied along the connecting rods oriented substantially parallel to the cylinder axis, no side forces are felt by the pistons as they are initially forced to slide along the cylinder walls. With more or the combustion forces directed towards the crankshaft and less towards the cylinder walls, improvements in efficiency are created by the reduction of friction, vibration, heat and wear within the cylinders.

Figure 6:
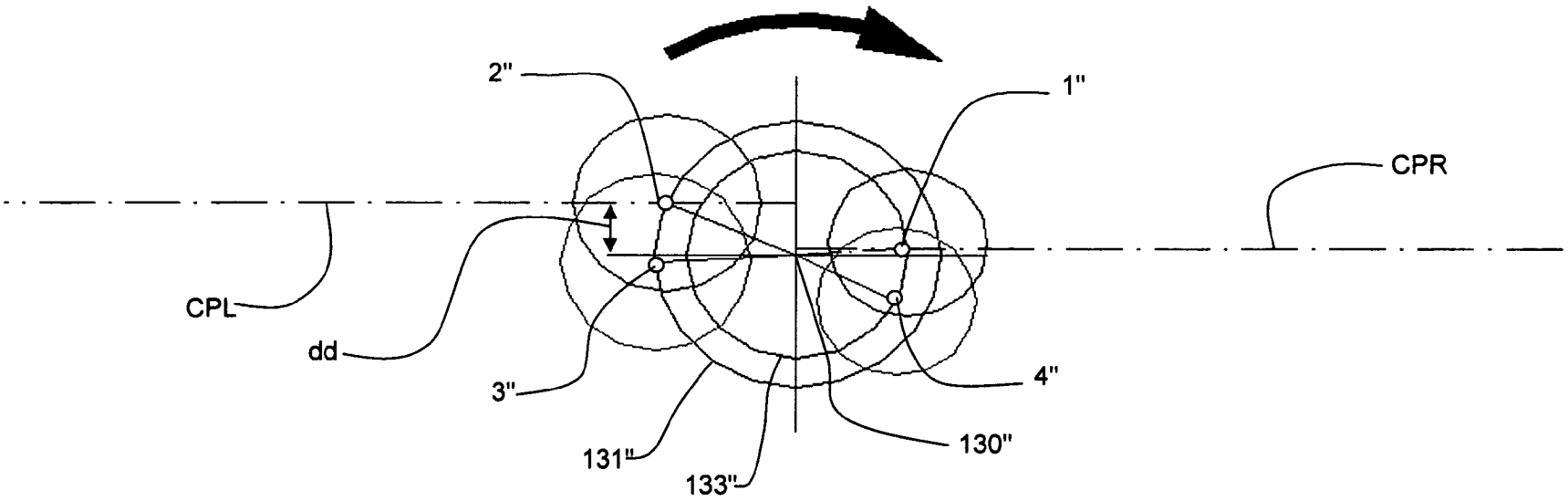
FIG. 6 is a diagram showing the rotation axis of the crankshaft in the center of two concentric circles which respectively represent the paths traveled by the piston journals in the second embodiment of the present invention during the engine cycle; and the location of the left and right piston journals shortly following TDC.
Figure 7:
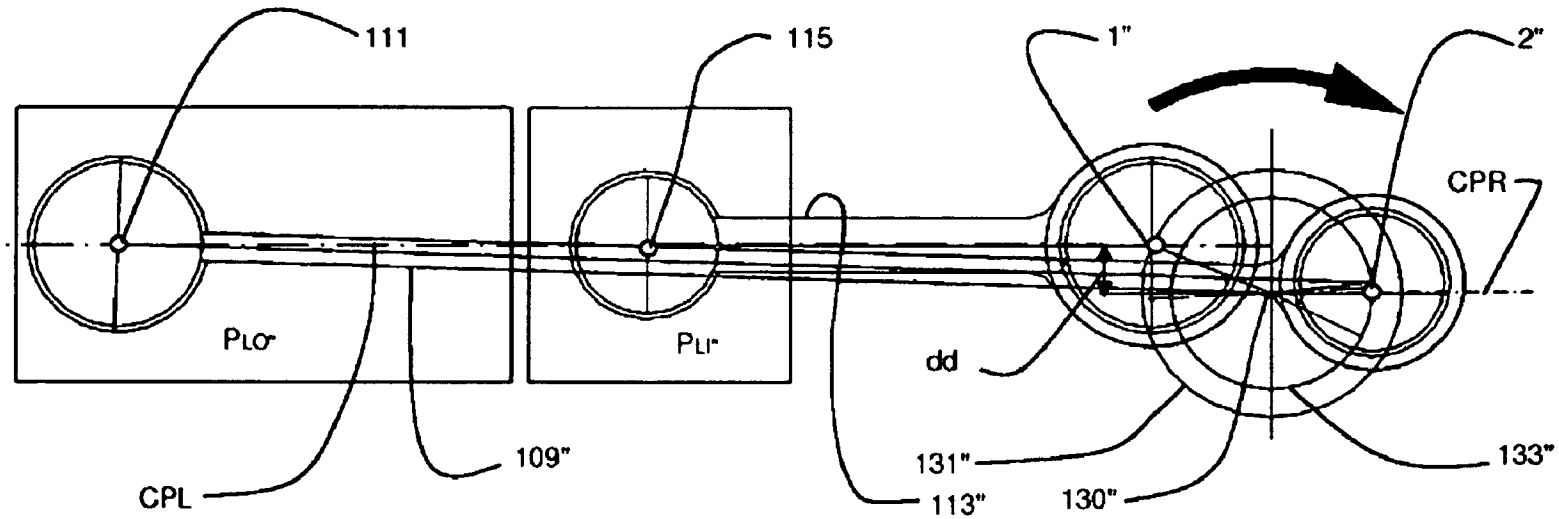
FIG. 7 is a simplified drawing of the left pistons, connecting rods and crankshaft of the second embodiment of the present invention shortly following TDC.

The second embodiment of the invention is described with reference to FIGS. 6 and 7. In the second embodiment, the pistons in one of the two opposing cylinders (the right cylinder in this example) have centers which move along a first axis that corresponds to the axis of its cylinder bore and lies in a horizontal plane CPR defined with the axis of rotation 130" of the crankshaft. The pistons PLO and PLI in the other opposing (left) cylinder are disposed to have their centers move along a second axis that corresponds to the axis of its cylinder bore CPL and is parallel to the first axis but vertically offset from the defined plane CPR by a predetermined distance "dd". In this embodiment, the push rod 113" for inner piston PLI" is connected to crank pin 1' and the push rod 114" for inner piston PRI" (not shown) is connected to crank pin 3'. The result is that each connecting push rod extending from an inner piston of each cylinder to the corresponding asymmetric arranged crank journal is substantially parallel to its respective cylinder axis at a predetermined point immediately following TDC when the expansion forces are near to their peak during the combustion portion of the cycle. In FIG. 7, the left cylinder is illustrated with pistons PLO" and PLI" as being slightly beyond TDC and the center line of push rod 113" connected to inner piston PLI is shown as being substantially parallel to the axis CPL. The pull rod 109 for the outer piston PLO is at a slight angle to the plane, but it is deemed an acceptable tradeoff in this type of engine. The long lever that pull rod 109" provides has the effect of generating much smaller side forces on the outer piston. Therefore less friction results against the outer piston cylinder wall than the inner pistons during the combustion expansion. By positioning the inner piston connecting push rods substantially parallel to their corresponding cylinder axes at these selected spots in the cycle just beyond TDC for each cylinder), the side forces, which conventionally result and are applied to the side walls of the inner pistons, are eliminated and friction is minimized to provide greater efficiency during the power stroke.

The two embodiments illustrate the inventive methods that have led to reduction in internal friction in the OPOC engine and provide significant improvements in operating efficiencies.

From the foregoing, it can be seen that there has been brought to the art a new and improved way to configure the orientation of cylinders and pistons with respect to the crankshaft in order to improve efficiencies of operation. It is to be understood that the preceding description of the embodiments is merely illustrative of some of the many specific embodiments that represent applications of the principles of the present invention. Clearly, numerous and other arrangements would be evident to those skilled in the art without departing from the scope of the invention as defined by the following claims.

The invention claimed is:

1. A method of reducing friction between pistons and cylinders in an internal combustion engine containing at least one pair of opposed cylinders, a pair of opposing inner and outer pistons in each cylinder, a single crankshaft, and a plurality of piston rods each connected between a piston and a corresponding asymmetric journal on said crankshaft, comprising the steps of:

positioning said cylinders opposing each other to have the centers of said opposing pistons within each cylinder move along the longitudinal axis of the cylinder during engine operation;

defining a centerline in each piston rod that extends between each piston connection and each journal connection positioning said crankshaft and asymmetric journals between said opposing cylinders to have the centerline of the piston rod connected between said inner piston and its corresponding journal oriented to be substantially parallel with said axis of longitudinal piston movement when the combustion forces reach their peak just after the inner piston reaches its top dead center position of the engine cycle.

2. The method of claim 1, further including the steps of:

positioning said cylinders opposing each other to have the longitudinal axis of each cylinder lie in a common plane; and positioning said crankshaft and said asymmetric journals between said opposing cylinders to have the crankshaft axis of rotation offset a predetermined distance from said common plane and to cause the centerlines of said piston rods for both inner and outer opposing pistons to be substantially parallel to the corresponding cylinder axis when the combustion forces reach their peak just after said opposing pistons reach their top dead center positions of the engine cycle.

3. The method of claim 2, further including the step of positioning said cylinders opposing each other to lie in a common horizontal plane.

4. The method of claim 3, further including the step of positioning said crankshaft to have its axis of rotation offset said predetermined distance from said common plane in a vertical direction.

5. The method of claim 2, further including the step of positioning said crankshaft to have its axis of rotation offset said predetermined distance from said common plane in a direction that is orthogonal to said plane.

6. The method of claim 2, wherein the step of positioning said cylinders opposing each other is performed to provide a common longitudinal axis for said opposing cylinders.

7. The method as in claim 6, further including the step of positioning said crankshaft and said asymmetric journals between said opposing cylinders to have the crankshaft axis of rotation orthogonal to and offset a predetermined distance from said common longitudinal axis for said opposing cylinders and to cause the centerlines of said piston rods for both inner and outer opposing pistons to be substantially parallel to said common longitudinal axis when the combustion forces reach their peak just after said opposing pistons reach their top dead center positions of the engine cycle.

8. The method as in claim 2, wherein at least one additional pair of opposed cylinders each with a pair of opposing inner and outer pistons in each cylinder, is added to said engine in the manner of said first pair of opposed cylinders with a plurality of piston rods each connected between a piston and an asymmetric journal on said single crankshaft, and further including the step of:

positioning said at least one additional pair of opposed cylinders to have the longitudinal axis of each cylinder lie in said common plane.

9. The method of claim 8, further including the step of positioning said crankshaft to have its axis of rotation offset said predetermined distance from said common plane in a direction that is orthogonal to said plane.

10. The method of claim 9, wherein the step of positioning said cylinders opposing each other is performed to provide a common longitudinal axis for each pair of said opposing cylinders.

11. An improved internal combustion engine containing a pair of opposed cylinders, a pair of opposing inner and outer pistons in each cylinder, a single crankshaft, and a plurality of piston rods each connected between a piston and a corresponding asymmetric journal on said crankshaft, the improvement comprising:

said cylinders being disposed opposing each other to have the centers of said opposing pistons within each cylinder move along the longitudinal axis of the cylinder during engine operation;

each piston rod that extends between each piston connection and each journal connection having a defined center line extending between said connections;

said crankshaft and asymmetric journals being disposed between said opposing cylinders to have the centerline of the piston rod connected between said inner piston and its corresponding journal oriented to be substantially parallel with said axis of longitudinal movement when the combustion forces reach their peak just after the inner piston reaches its top dead center position of the engine cycle.

12. The improved engine of claim 11, wherein said opposing cylinders are disposed to have the longitudinal axis of each cylinder lie in a common plane; and said crankshaft and said asymmetric journals disposed between said opposing cylinders to have the crankshaft axis of rotation offset a predetermined distance from said common plane to orient the centerlines of said piston rods for both inner and outer opposing pistons to be substantially parallel to the corresponding cylinder axis when the combustion forces reach their peak just after said opposing pistons reach their top dead center positions of the engine cycle.

13. The improved engine of claim 12, wherein the longitudinal axis of each said cylinder lie in a common horizontal plane.

14. The improved engine of claim 13, wherein said crankshaft has its axis of rotation offset said predetermined distance from said common plane in a vertical direction.

15. The improved engine of claim 12, wherein said crankshaft has its axis of rotation offset said predetermined distance from said common plane in a direction that is orthogonal to said plane.

16. The improved engine of claim 12, wherein said opposed cylinders being disposed along a common longitudinal axis.

17. The improved engine of claim 16, wherein said crankshaft and said asymmetric journals between said opposing cylinders are disposed to have the crankshaft axis of rotation orthogonal to and offset a predetermined distance from said common longitudinal axis for said opposing cylinders, and cause the centerlines of said piston rods for both inner and outer opposing pistons to be substantially parallel to the common longitudinal axis when the combustion forces reach their peak just after said opposing pistons reach their top dead center positions of the engine cycle.

18. The improved engine of claim 12, wherein at least one additional pair of opposed cylinders each with a pair of opposing inner and outer pistons in each cylinder is included with a plurality of piston rods each connected between a piston and an asymmetric journal on said single crankshaft, and further wherein said at least one additional pair of opposed cylinders is disposed to have the longitudinal axis of each cylinder lie in said common plane.

19. The improved engine of claim 18, wherein said crankshaft is disposed to have its axis of rotation offset said predetermined distance from said common plane in a direction that is orthogonal to said plane.

20. The improved engine of claim 19, wherein said cylinders opposing each other are disposed to provide a common longitudinal axis.

* * * * *